US005447258A

United States Patent [19]

Suzuki

[11] Patent Number: 5,447,258

[45] Date of Patent: Sep. 5, 1995

[54] SPOUT FOR LIQUID PUMP

[75] Inventor: Kazuo Suzuki, Koto, Japan

[73] Assignee: Yoshino Kogyosho Co., Ltd., Tokyo, Japan

[21] Appl. No.: 193,040

[22] PCT Filed: Dec. 28, 1992

[86] PCT No.: PCT/JP92/01735

§ 371 Date: Apr. 4, 1994

§ 102(e) Date: Apr. 4, 1994

[87] PCT Pub. No.: WO93/25319

PCT Pub. Date: Dec. 23, 1993

[30] Foreign Application Priority Data

Jun. 17, 1992 [JP] Japan ..... 4-158309

[51] Int. Cl.[6] ..... B65D 5/72

[52] U.S. Cl. ..... 222/494; 222/341; 222/507; 222/527; 239/533.13; 239/DIG. 12

[58] Field of Search ..... 222/321, 341, 491, 494, 222/507, 527; 239/533.13, 602, DIG. 12

[56] References Cited

U.S. PATENT DOCUMENTS

| | | | |
|---|---|---|---|
| 5,033,647 | 7/1991 | Smith et al. | 222/494 X |
| 5,163,588 | 11/1992 | Cater | 222/341 X |
| 5,192,006 | 3/1993 | van Brocklin et al. | 222/341 X |

FOREIGN PATENT DOCUMENTS

| | | | |
|---|---|---|---|
| 0457245 | 11/1991 | European Pat. Off. | 222/494 |
| 3836236 | 4/1990 | Germany | 222/341 |
| 51-21367 | 6/1976 | Japan . | |
| 53-51848 | 5/1978 | Japan . | |
| 59-74864 | 5/1984 | Japan . | |
| 62-75864 | 5/1987 | Japan . | |
| 64-44064 | 3/1989 | Japan . | |
| 1-84765 | 6/1989 | Japan . | |

*Primary Examiner*—Andres Kashnikow
*Assistant Examiner*—Joseph A. Kaufman
*Attorney, Agent, or Firm*—Oliff & Berridge

[57] ABSTRACT

A spout for a liquid pump includes a first valve body mounted onto an outlet of a liquid pump. The first valve body includes a bottom part that has a flowing hole, and a cylindrical body and a shaft extend from the bottom part. The cylinder body and the shaft define an annular space in which the flowing hole is disposed. A second valve body includes an engaging part engaged with a distal end of the cylinder body of the first valve body, and a cylindrical body extends from the engaging part. The cylindrical body is partially disposed within the annular space and has a smaller diameter at an end so as to form an end opening part of the cylindrical body that is resiliently fittable on the shaft.

4 Claims, 2 Drawing Sheets

SPOUT FOR LIQUID PUMP

BACKGROUND OF THE INVENTION

The present invention relates to a spout for a liquid pump. More particularly, this invention relates to a spout in which an outlet is closed to prevent contents from getting dry when the spout is not in use.

One spout, which is mounted onto an outlet of a liquid pump and closed to prevent its contents from getting dry when the spout is not in use, is described in Japanese Utility Model Publication No. 21367/1976.

As shown in FIG. 2, such a conventional spout is formed with a pipe 132 extending from a base 131 that provides a passage 130 inside and an end of the pipe 132 that is closed by a tap 133. A hole 134 is provided on a side surface near the end of the pipe 132, which enables the passage 130 to communicate with the outside. A cap 135 is provided on the end of the pipe 132 so as to close the hole 134. Further, a spout 136 is provided in an end of the cap 135. When the contents are supplied through the passage 130 by a pump not shown, the inside of the cap 135 is pressurized through the hole 134 and is expanded. Thereby, the content of the pipe are sent through the hole 134 between the pipe 132 and the cap 135 and ejected outwardly from the spout 136. When it is not in use, because the cap 135 and the pipe 132 are closely fitted, the contents are isolated from the open air.

FIG. 3 shows a fixed ring 137 provided circumferentially on a cap 135 so as to strengthen the fixation of the cap 135 to the pipe 132, and FIG. 4 shows its motion (i.e., during dispensing).

FIG. 5 shows a passage 230 within a pipe 232 forming a trigonal pyramid at an end, accordingly, a hole 234 is aslant.

In the conventional spout described above, however, because a cap 135 and a pipe (132 and 232) are closely fitted when the pump is not in use, the contents tend to work as glue, which prevents easy operation of the spout.

In the conventional spout shown in FIGS. 3 and 5, in addition to the foregoing problems, the spout tends to be complicated and troublesome to manufacture because a fixed ring 137 and 237 must be provided.

SUMMARY OF THE INVENTION

It is therefore an object of the present invention to provide a spout for a liquid pump, of which assembly is easy and the closing motion is smooth and accurate.

To achieve the object described above, the present invention provides a spout for a liquid pump, comprising: a first valve constitutive body mounted onto an outlet of a liquid pump, providing a bottom part which has a flowing hole with a cylinder body, and being formed with a shaft extended from the bottom; an engaging part being formed to be engaged to the cylinder body of the first valve constitutive body; and a second valve constitutive body, which is extended from the engaging part, providing a cylindrical body having a smaller diameter at an end so as to form an end opening part of the cylindrical body to fit onto the shaft.

In the above spout, the second valve constitutive body may be formed out of flexible synthetic resin to provide resiliency to the cylindrical body. In the above spout, it is easy to assemble the spout closed constantly because it can be constituted by fitting the second valve constitutive body into the first valve constitutive body.

In addition, in the inventive spout, the end opening part of the cylindrical body may be fitted outwardly to the shaft when it is not in use, that is, the inside of the liquid pump is airtight when not in use. On the other hand, pressing an outlet of the liquid pump makes the end opening part of the cylindrical body slightly open, which discharge the contents. In the above spout, at this time, a contact area of the shaft and the end opening part of the cylindrical body is limited to nearly a circular line, which prevents the jamming of the content and makes the opening and closing motion easy and accurate in comparison with conventional spouts which have problems because the shaft and the opening of the end of the cylindrical body are closely fitted with a large area.

Other features and advantages of the present invention will become apparent from the following description taken in conjunction with the accompanying drawings.

DETAILED DESCRIPTION OF PREFERRED EMBODIMENTS

Now, an embodiment of a spout for a liquid spray according to the present invention will be described with reference to FIG. 1.

Figure 1:
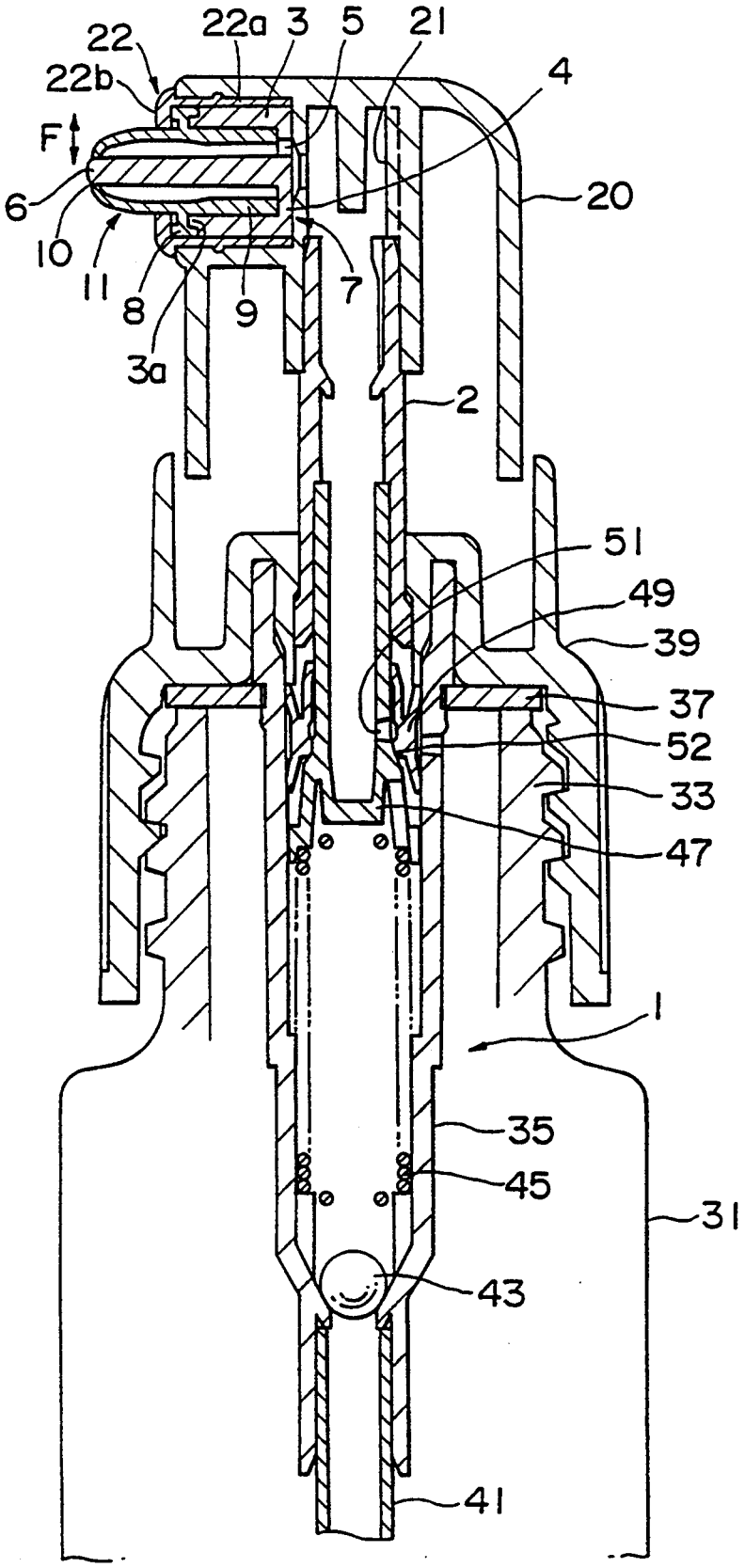
FIG. 1 is a sectional view showing an embodiment of a spout for a pump according to the present invention.
Figure 2:
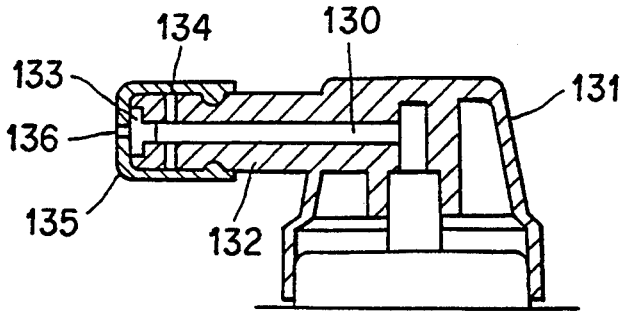
FIG.2 PRIOR ART
FIG. 2 is a sectional view showing a conventional spout for a pump.
Figure 3:
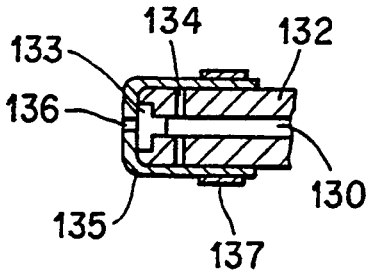
FIG.3 PRIOR ART
FIG. 3 is a sectional view showing a conventional spout for a pump.
Figure 4:
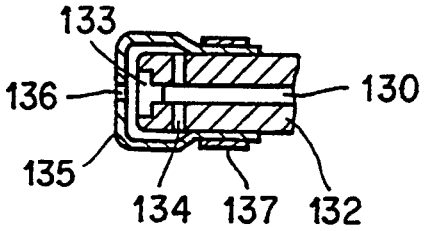
FIG.4 PRIOR ART
FIG. 4 is a sectional view showing the conventional spout for a pump of FIG. 3 in order to explain its motion.
Figure 5:
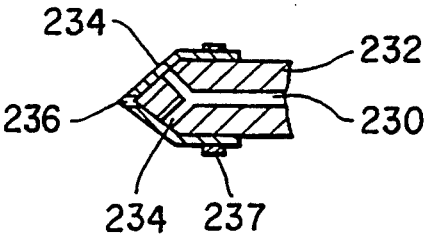
FIG.5 PRIOR ART
FIG. 5 is a sectional view showing a conventional spout for a pump.

In FIG. 1, a liquid pump 1 shows a general push-down pump. This pump will be described briefly in the following description. A cylinder 35 is inserted into a container main body 31 through a cylindrical opening part 33 of the container main body 31. A ring plate 37 has an outer diameter greater than that of the opening diameter of the cylindrical opening part 33 to be fitted to the upper part of the cylinder 35. The ring plate 37 and the upper part of the cylinder 35 are covered with a cap 39 that screws onto the cylindrical opening part 33 so as to be fixed to the opening part 33.

A suction pipe 41 is connected to the bottom opening of the cylinder 35. A ball valve 43 is provided on the inside of the lower part of the cylinder 35. There is also provided a spring 45 inside the upper part of the same. A piston pipe 47, which is urged upwards by the spring 45, is fitted in the cylinder 35 in an up-and-down freely movable manner. A piston 49 is provided on the circumference of the piston pipe 47 and contacts closely with an inner surface of the cylinder 35. While a bottom of the piston pipe 47 is closed, a communicating hole 51 is provided at a portion slightly upwards from the bottom. The piston 49 freely moves up and down relative to the piston pipe 47, which constitutes a check valve 52, to open and close the communicating hole 51 between the piston 49 and piston pipe 47 by the up-and-down motion.

A pipe 2 is connected to the piston pipe 47 of the liquid pump 1, which allows the contents that are pressurized by the liquid pump 1 to rise through the pipe 2. While a pressure base 20 is provided on an upper end of the pipe 2, the liquid pump 1 is operated by pressing down an upper face of the pressure base 20. While a passage 21 is formed to be communicated to the pipe 2, which is an outlet within the pressure base 20, a first valve constitutive body 7 that communicates with the passage 21 is also provided.

In the first valve constitutive body 7, a cylinder body 3 having a bottom part 4 is formed like a cup, a flowing hole 5 is provided near a center of the bottom 4, and a shaft 6 extends from the center of the bottom 4. An end of the shaft 6 has a hemisphere-like shape that projects a large extent away from the cylinder body 3. A projecting part 3*a* is formed on an inner circumferential side at an edge of the cylinder body 3.

A second valve constitutive body 11 is mounted on the cylinder body 3 of the first valve constitutive body 7. In the second valve constitutive body 11, an engaging part 8 is formed circumferentially so as to fit onto the projecting part 3*a* to be engaged to the edge of the cylinder body 3. A cylindrical body 9 extends from an inner surface of the engaging part 8. The cylindrical body 9 is fitted into the cylinder body 3, and also extends in the same direction of the shaft 6. The cylindrical body has one end having a smaller diameter and a streamlined-shape at an end that forms an end opening part 10. Further, the end opening part 10 is formed to be loosely fit onto the shaft 6. While the second valve constitutive body 11 is formed out of flexible synthetic resin, the end opening part 10 fits loosely to the shaft 6.

The first valve constitutive body 7 and the second valve constitutive body 11, being assembled in such a manner are fixed air-tight, as well as liquid-tight to the pressure base 20 by a stopper 22. The stopper 22 includes a cylinder body 22*a* that exists between an outer surface of the cylinder body 3 and the pressure base 20, and also includes a ring-shaped body 22*b* having a smaller diameter than that of the cylinder body 22*a* on an end of the cylinder body 22*a*. The ring-shaped body 22*b* enables the first valve constitutive body 7 to be fixed into the pressure base 20 by pressing the engaging part 8.

Now, in the liquid pump described above, the operation will be described below.

By pressing down the pressure base 20 and releasing it as seen by direction F in FIG. 1, the spring 35 makes the piston pipe 47 and the piston 49 rise, which allows the check valve 52 to close so that negative pressure is created within the cylinder 35. Therefore, the ball valve 43 is open, which causes suction of the liquid within the container main body into the cylinder 35 through the suction pipe 41. Pressing down the pressure base 20 again closes ball valve 43 and high pressure is created in the cylinder 35 to open the check valve 52, which causes the liquid to flow into the pipe 2 so that the outlet of the liquid pump 1 is pressurized. Consequently, the pressure is also applied to the end opening part 10 so that the end opening part 10 is expanded to make a space between the shaft 6 and the end opening part 10, which enables the contents to be discharged. At this time, the end opening part 10 is in contact with the shaft 6 with little area, nearly a circular path or line. As a result, according to the above spout for the liquid pump, even if viscous contents are to be discharged, it is not necessary to care about the jamming of the contents, which is a problem for the conventional spout having a big contact area. In addition, the operation is easy and smooth.

In addition, because the cylinder body 3 and the shaft 6 of the first valve constitutive body 7, the engaging part 8 and the cylindrical part 9 of the second valve constitutive body 11, and the cylinder body 22*a* of the stopper 22 have a common axis, the assembly of the pressure base 20 can be done in one direction, which facilitates assembly.

Industrial Applicability

As described, the present invention is very useful as a spout for a pump-type container. In particular, because the spout can be closed air and liquid tight when it is not in use, it is useful for a container which contains something that gets dry easily or may cause jamming in a passage.

I claim:

1. A spout for a liquid pump, comprising:

a first valve body mounted onto an outlet of a liquid pump, said first valve body including a bottom part having a flowing hole, said first valve body also having a cylinder body and a shaft extending from the bottom part, said cylinder body and said shaft defining dan annular space in which said flowing hole is located; and a second valve body having an engaging part engaged with a distal end of the cylinder body of said first valve body, said second valve body having a cylindrical body extending from the engaging part, said cylindrical body being disposed at least partially within said annular space and having a smaller diameter at an end thereof, said cylindrical body being formed with an end opening part fittable onto said shaft.

2. The spout for the liquid pump claimed in claim 1, wherein said second valve body comprises a resilient, flexible synthetic resin.

3. The spout for the liquid pump claimed in claim 1, wherein an outer circumference of the shaft contacts and is surrounded by an inner circumference of said end opening part.

4. The spout for the liquid pump claimed in claim 1, wherein said cylinder body and the shaft of said first valve body, and the engaging part and the cylindrical body of the second valve body have one common axis.

* * * * *